United States Patent [19]

Shipman, Sr.

[11] Patent Number: 4,469,211

[45] Date of Patent: Sep. 4, 1984

[54] COIN MECHANISM FOR VENDING MACHINE

[75] Inventor: Robert V. Shipman, Sr., Pasadena, Calif.

[73] Assignee: Shipman Manufacturing Co., Inc., Los Angeles, Calif.

[21] Appl. No.: 399,461

[22] Filed: Jul. 19, 1982

[51] Int. Cl.[3] ..... G07F 5/04

[52] U.S. Cl. ..... 194/1 G; 194/DIG. 17

[58] Field of Search ..... 194/1 G, 84–87, 194/DIG. 2, DIG. 17

[56] References Cited

U.S. PATENT DOCUMENTS

| | | | |
|---|---|---|---|
| 1,146,018 | 7/1915 | Patterson . | |
| 1,947,999 | 2/1934 | McCormick et al. . | |
| 4,375,255 | 3/1983 | Roberts | 194/1 G |

OTHER PUBLICATIONS

Shipman Manufacturing Co. Price List, Aug. 21, 1972.
Triplex Deluxe Stamp Machine Booklet, 1977.

*Primary Examiner*—Stanley H. Tollberg
*Attorney, Agent, or Firm*—Kenneth J. Hovet

[57] ABSTRACT

A mechanism for actuating the vending of product from a machine upon the insertion of a predetermined number of specified coins. The mechanism includes a coin member having a partitioned surface that cooperates with housing parts to form a coin accumulation chamber. Upon insertion into the mechanism, the coins become aligned edgewise. The next-to-last coin is located to deflect the last coin upon a ledge. The ledge is part of the partitioned coin member and is situated to locate a portion of the coin beyond the member's periphery. This allows contact with a pin extending from an adjacent manually rotatable lever. After inserting the specified coins, a user of the vending machine will push down on the lever. This force will be transmitted via the pin against the coin, which, in turn, transmits the force through the ledge to the coin member. As the coin member rotates, the coins drop into a coin box.

10 Claims, 6 Drawing Figures

COIN MECHANISM FOR VENDING MACHINE

BACKGROUND OF THE INVENTION

1. Field of the Invention

The present invention relates to vending machines, and, more particularly, to coin mechanisms used to actuate such machines.

2. Description of the Prior Art

Vending machines require dependable and reliable mechanisms for receiving the requisite size and number of coins prior to effecting the dispensation of product. Oftentimes, such machines are the subject of abuse, weather extremes, fraud attempts and the like. As such, it is essential that the mechanisms utilize non-complex, tolerant and effective parts for long lasting trouble-free operation.

Somewhat complicated prior art coin mechanisms are those described in U.S. Pat. Nos. 3,900,093 and 4,220,234. These mechanisms utilize a combination of electronic parts in cooperation with mechanical systems. Although such mechanisms may be versatile and perform well under ideal conditions, they are inherently expensive and are prone to require frequent maintenance under the aforementioned harsh conditions of typical vending machine use.

Representative coin devices of a mechanical nature only, are those described in U.S. Pat. Nos. 2,040,983, 2,736,415 and 2,806,573. These devices, while not requiring electronic circuitry, do require complicated gear, cam and/or locking mechanisms. In effect, these prior art devices have become overburdened with the perceived need to be adaptable to all manner, type, and combination of coins. In reality, this is wholly unnecessary and is not at all cost effective.

SUMMARY OF THE INVENTION

The present invention provides a highly reliable and effective means for actuating a vending machine after receiving a specified number of coins of a predetermined denomination. A coin member receives the coins and utilizes one of them as a transmitter of force to actuate the vending process.

The coin member includes unique partition means that gravity aligns the coins in an edgewise manner whereby the next-to-last coin will deflect the last coin into a force transmission position for subsequent actuation of the vending machine. The coins themselves thereby function as integral parts of the mechanism and avoid the necessity of complex trip mechanisms, microswitches, locking fingers, cams and the like.

DESCRIPTION OF THE PREFERRED EMBODIMENT

Figure 1:
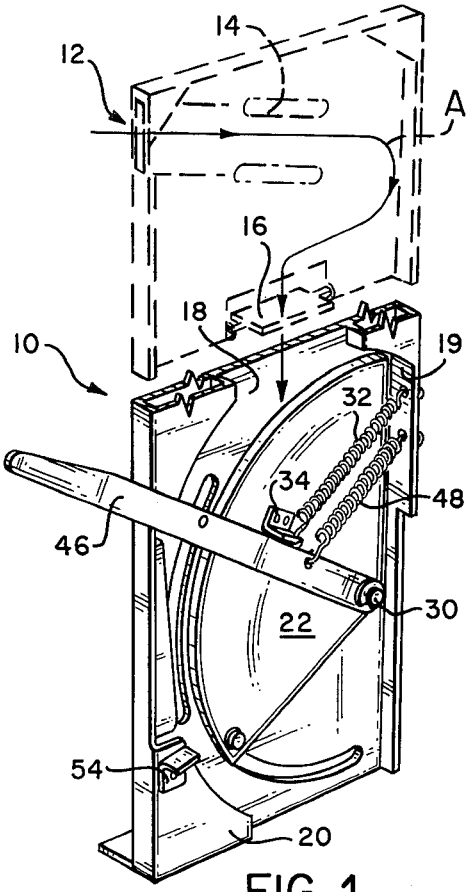
FIG. 1 is a perspective view of a portion of a coin mechanism representing the present invention with phantom lines depicting schematically an overall mechanism and coin path therethrough.

With reference now to the drawings, and more particularly to FIG. 1 thereof, an overall coin mechanism 10 is shown which is used in a vending machine (not shown) for actuating the dispensation of product therefrom. The portion of FIG. 1 shown in solid line represents the present invention with the phantom portion representing known features of prior art mechanisms.

Arrow A depicts the path of a coin beginning at coin slot 12 and passing through size detection means 14 and weight comparator means 16. In the presently described embodiment, four coins of identical denominations (and diameter) are utilized. As such, the size detection and weight comparator means are adapted to reject any coin or fraudulent slug not meeting weight and size dimensions of the aforesaid four coins. It will be understood, however, that the essential features of the invention can readily be adapted to accommodate other numbers and sizes of coins. Of course, such coins must be predetermined so that the basic components of the invention can be arranged and sized to accommodate such coins.

The mechanism comprising the present invention includes a basewall 18 and spaced-apart outerwall 20. The walls are set apart by appropriate spacer means (not shown) a distance sufficient to allow movement of coins therebetween. A large portion of the outerwall is cut away to form a circular edge 21 that allows for placement and rotation of coin member 22.

The coin member is of a flat disk-like construction shaped like a segment of a circle with the free edge 24 thereof comprising an arc of a circle bounded by intersecting straight edges 26, 28. Offset inwardly from the intersection of the edges is aperture 29 defining the center axis of said arc.

The coin member is mounted for rotation about common pivot 30 extending through aperture 29. The common pivot is secured to basewall 18 adjacent endwall 19 with free edge 24 radially inward from cutout edge 21. In this way, coin member 22 will freely rotate within the cutout area.

Figure 2:
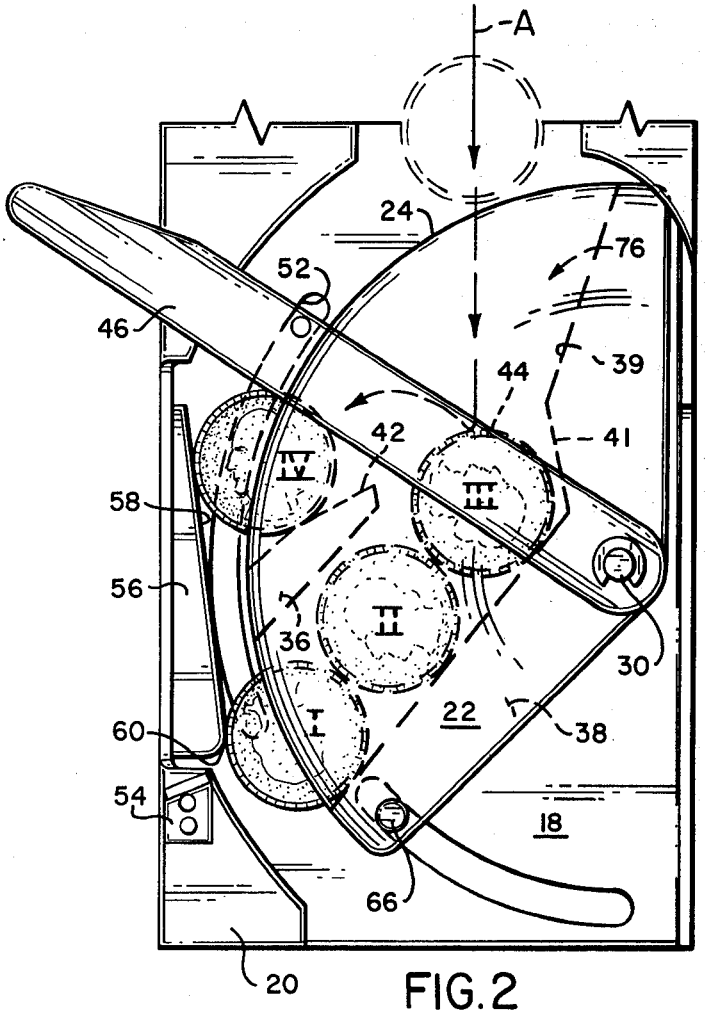
FIG. 2 is a side evelation view of the coin mechanism of FIG. 1 showing the required number of specified coins in alignment for actuation of a vending assembly.

The coin member includes biasing means shown as tension spring 32. The spring holds the coin member in a first position as shown in FIGS. 1 and 2 with edge 26 in about a vertical position adjacent endwall 19. The spring is attached to the endwall and to a lug 34 secured to the coin member outerface.

Figure 3:
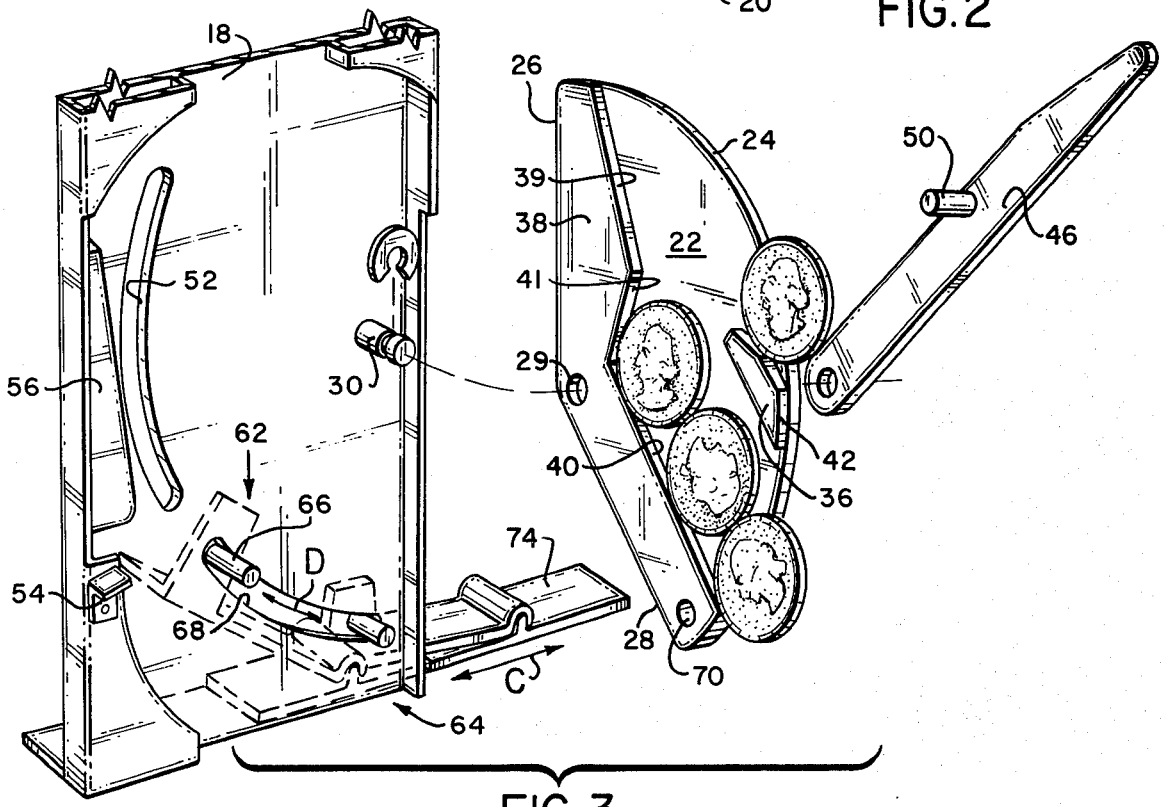
FIG. 3 is a perspective view of the mechanism of FIG. 1 with the coin member and lever broken-away.
Figure 6:
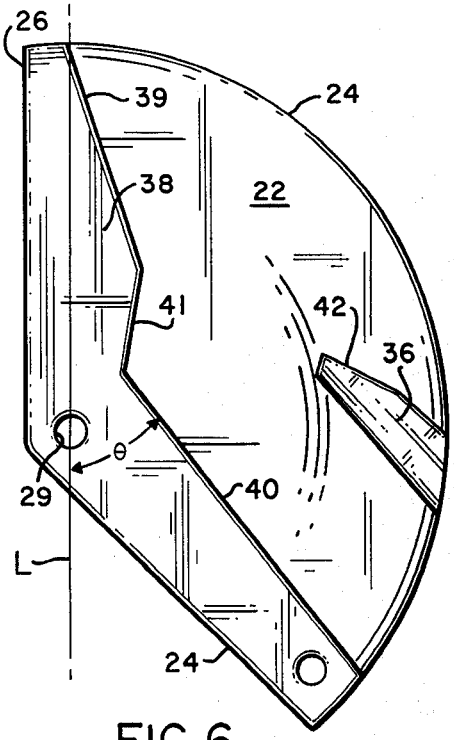
FIG. 6 is a side elevation view of the innerface of the coin member shown in FIGS. 1–5.

As best shown in FIGS. 3 and 6, the inner face of coin member 22 has secured thereto first partition part 36 and second partition part 38. The second partition part is provided with an inner edge 40 that somewhat proximates the angular alignment of edge 28. The inner edge forms an acute angle $\theta$ with an imaginary vertical line "L" drawn normal to the axis of aperture 29 as depicted in FIG. 6. The edge 40 serves to support and align coins as they come to rest thereon in a manner to be hereinafter described.

The upper portion of second partition part 38 includes deflecting edge 39 and support edge 41. With reference to FIG. 3, edge 39 is inclined outwardly from vertical line "L" and merges into edge 41 which is inclined toward the vertical line. Edge 39 is generally longer than edge 41 and serves to guide coins dropping into the coin accumulation area 76 toward inner edge 40. With the next-to-last coin present, it also cooperates with such coin to deflect the last coin toward the first partition part. Support edge 41 functions to locate the next-to-last coin so that it can properly effect the deflection of the last coin entering area 76.

The first partition part 36 is secured to the inner face of coin member 22 adjacent the free edge 24 thereof for the purpose of providing a ledge for the last one (IV) of the predetermined number of coins. The upper surface or ledge 42 of part 36 is inclined downwardly toward free edge 24 and is located below the top edge 44 of the next-to-last coin (III).

Adjacent the outer face of coin member 22 is rotatable lever 46. The lever is mounted for rotation about common pivot 30 and extends radially outward beyond the housing walls whereby a vending machine user can manually move the lever downwardly in the direction of Arrow B. The lever is maintained in its first normal position by biasing means such as tension spring 48. The spring connects endwall 19 and the lever to bias the lever in the aforesaid first position against coin member lug 34. Unless acted upon, the lever will be in its first position when the coin member is at its first position as shown in FIGS. 1 and 2.

Located on the lever radially outward from coin member free edge 24 and radially inward from cut-out edge 21 is a push means shown as pin 50. The push pin extends perpendicularly from the inner face of the lever into curved slot 52 of the basewall 18. Because the lever and coin member share a common pivot, the pin will move in an arc corresponding to the arc of edges 21 and 24.

Figure 4:
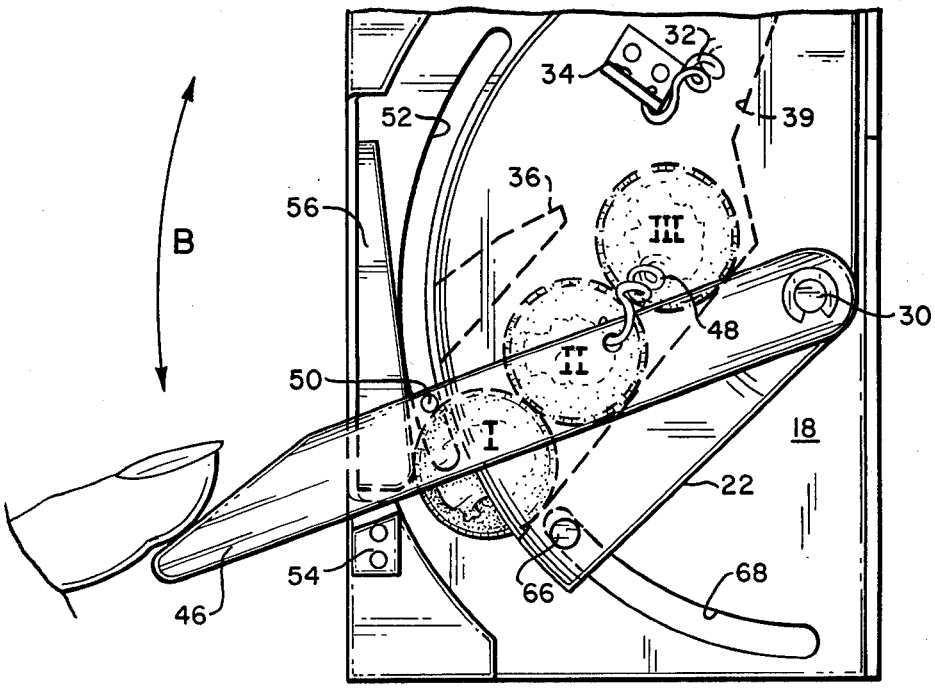
FIG. 4 is a side elevation view of the mechanism of FIG. 1 showing non-operation of the mechanism when less than the required number of coins is present.

The lowermost second position of the layer is defined by a lever constraint means comprising stop member 54. The stop member is secured to outerwall 20 and is located so that push pin 50 will not forcibly contact first coin (I), if present. This arrangement is best shown in FIG. 4 wherein lever 46 is shown in its second position with pin 50 out of contact with coin (I). It can further be seen that in the absence of coin (IV), coin member 22 remains in its normal first position regardless of lever movement. Tension spring 48 will cause lever 46 to return to its first position upon release of downward pressure.

Between the housing walls and radially outward from the path of pin 50 and/or slot 52 is coin abutment means 56. The coin abutment means coacts with the second partition part 38 to support first coin (I). It also cooperates with first partition part 36 to support the last coin (IV) in its position upon ledge 42. The distance between the upper inner face 58 of the abutment means and the free end of ledge 42 of the first partition part is less than the diameter of coin (IV). Similarly, the distance between the free end of inner edge 40 and the lowermost innerface portion 60 of the abutment means is less than the diameter of coin (I).

Figure 5:
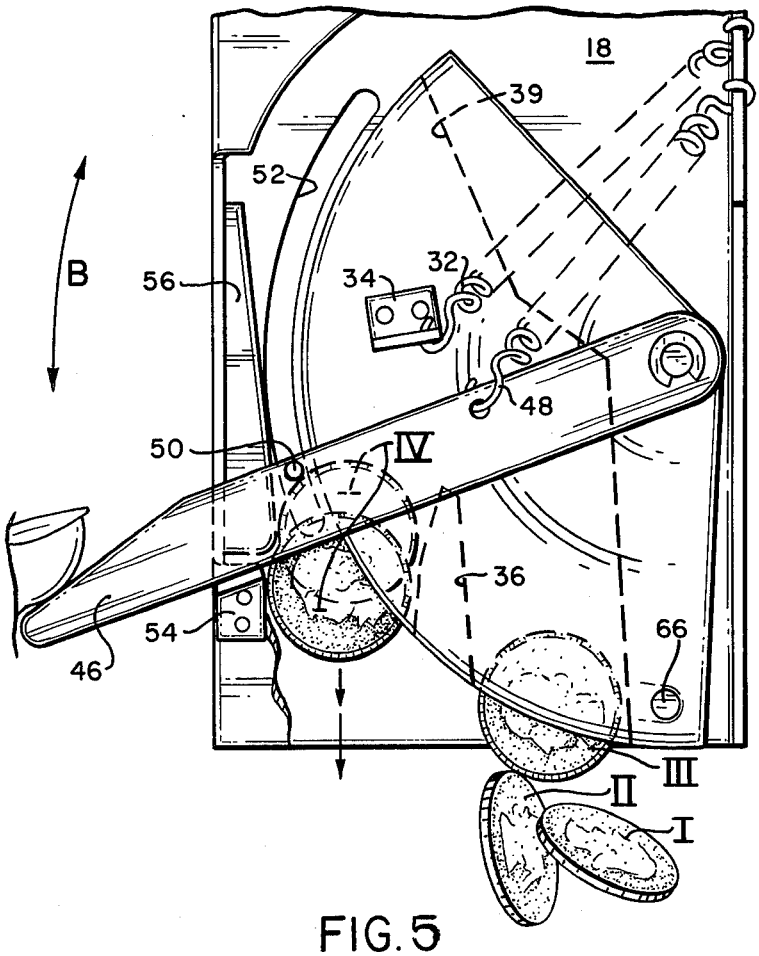
FIG. 5 is a side elevation view of the mechanism of FIG. 1 showing operation in the presence of the required last coin.

It will be noted that the above dimensions are defined when the coin member is in its first position. When the coin member is in its second position, as depicted in FIG. 5, there will be no abutment support for coins (I), (II), and (III), and these coins will fall by gravity into a coin storage box (not shown). When the coin member is in its second position, the upper edge 42 of partition part 36 will be spaced from the lowermost innerface 60 a distance greater than the diameter of coin (IV). As such, this coin will also drop by gravity into the coin storage box.

Connected to the coin member 42 is vending actuation means shown generally by reference number 26. The vending actuation means serves to connect the coin member with a vending assembly shown generally by reference number 64. It will be appreciated that the vending assembly can take any form and its construction will be dictated by the particular product to be dispensed from the vending machine. Likewise, the nature of the actuation means 62 will be determined by the requirements of the vending assembly.

As shown in FIG. 3, the actuation means 26 includes pin 66 extending through slot 68 in basewall 18. The pin 66 extends through orifice 70 of coin member 22. The pin is secured to bracket 72 which, in turn, is hinged to part 74 of the vending assembly.

From the above, it will be seen that as coin member 22 moves between its first and second positions, pin 66 will simultaneously reciprocate as shown by Arrow D and cause the force thereof to be transmitted into a reciprocating movement of part 74 shown by Arrow C. Such reciprocating movement acting in conjunction with other vending parts can effect the dispensation of products such as cards, booklets, maps, folders, tickets, stamps, and the like. It is within the purview of the present invention to dispense a wide variety of vendable products by appropriately adapting the vending actuation means and the vending assembly for the desired product.

Operation

It is expected that the overall coin mechanism 10 will be located inside the cabinet of a vending machine (not shown). The coin slot 12 and free end portion of lever 46 will be accessible outside of the cabinet with the lever and coin member in their upraised normal first positions.

In accordance with posted instructions, a user will insert the specified coins into the coin slot and then push downwardly on lever 46 to dispense product via the vending assembly 64. The lever will thereafter be released and the tension springs will rotate the coin member and lever from the second position to the aforesaid first position for another user.

Describing the operation in detail, coins of specified denomination will be inserted into slot 12 and move along path A through size detection means 14. If the coin's diameter (its denomination) is improper for the preset mechanism, the coin will be rejected and passed out a rejection slot (not shown). Upon passing the size detection means, the coin will travel to a weight comparator means 16. Again, if the coin is improper in weight, as preset by the specified denomination, it will be rejected and passed out the aforesaid rejection slot. If the coin is of proper weight, it will drop by gravity in the direction shown by Arrow A into the coin accumulation area shown generally by reference number 76 in FIG. 2. This area is defined by the space between basewall 18 and the inner face of coin member 22, and between edges 39, 40, 41, and the first part 36 and abutment faces 58, 60.

The first coin (I) entering the accumulation area will be guided, if necessary, by edge 39 and fall against inner edge 40 and roll down said edge until it abuts against the lowermost abutment face 60. The second coin (II) will follow the above described path and come to rest against an upper edge of the first coin. The third coin (III) will also follow the same path and come to rest against the upper edge of the second coin, inner edge 40 and support edge 41. Here the location of abutment face 60 and the length and inclination of inner edge 40 function to locate coin (III) with its top edge 44 at a vertically higher position than the ledge 42 or part 36.

The fourth coin (IV) path is shown in phantom in FIG. 2. Its fall will be guided by edge 39 until its contacts the upper edge 44 of coin (III). Here the coin edge 44 and edge 39 cooperate to deflect the coin toward partition part 36 where it comes to rest upon ledge 42 in abutment with upper abutment face 58.

The upper abutment face is discreetly located in accordance with the predetermined coin diameter so that a portion of the coin's circumference will extend beyond the free edge 24 of the coin member. As so disposed, when a user moves lever 46, push pin 50 will contact the coin circumference and transmit force through the coin to the part 36. Continued downward movement of the lever will cause the coins and coin member to move simultaneously until the lever is pushed to its lowermost position as shown in FIG. 5. At this point, coins (I), (II), and (III) will already have dropped from the coin accumulation area into a storage box. Also, coin (IV) will have been pushed along the innerface of the abutment means just beyond the lowermost face 60 where it will thereafter drop by gravity into the coin box with the other three coins.

As best shown in FIG. 4, in the absence of a coin on ledge 42, the lever 46 will simply move between its first and second positions as shown by Arrow B without causing any movement of coin member 22. Only when the required last coin is inserted into the mechanism will the coin member be caused to rotate and result in dispensation of product via movement of the actuation means 62 and vending assembly 64.

Of course, the partition parts and abutment means can be arranged to effect the proper length, angular alignment and spacing relationships to allow a variety of predetermined denominations of coins to operate the mechanism. It is the use of the coins themselves in a cooperating relationship with the structural elements of the mechanism that is the unique advantage of the present invention. Such structural design and coin integration provide for substantial savings in cost and allows for the elimination of numerous and complex parts for a more maintenance-free mechanism.

While the invention has been described with respect to a preferred embodiment, it will be apparent to those skilled in the art that various modifications and improvements may be made without departing from the scope and spirit of the invention. Accordingly, it is to be understood that the invention is not to be limited by the aforesaid illustrative embodiment, but only by the scope of the appended claims.

I claim:

1. In a coin mechanism for a vending machine requiring a predetermined number of specific coins before a product will be dispensed comprising:

spaced-apart housing walls having a defined coin path therebetween;

a coin member mounted for rotation about a center axis upon one of said walls providing a coin accumulation area in coin receiving relation below said path, said area including partition parts secured to a surface thereof;

a first one of said partition parts being disposed proximate the free edge of said member to provide a ledge for the last coin of said predetermined number and cause a portion of said coin to extend beyond said outer edge;

a second one of said partition parts spaced from said first part a distance at least equal to the predetermined diameter of said coins;

a rotatable lever mounted upon one of said walls coextensive with said coin member center axis having push means extending from the lever to a location adjacent the free edge of the member for engagement with the portion of said coin extended beyond said free edge, said coin member and lever being rotatable between first and second positions including biasing means to maintain them at the first position until acted upon, the free edge of said coin member formed as an arc corresponding to the path of said push means when the lever is rotated; and, coin abutment means attached to a housing wall radially outward from the path of said push means, said abutment means cooperating with the second partition part to retain a predetermined number of coins in said accumulation area.

2. The mechanism of claim 1 wherein said second part and coin abutment means cooperate to arrange the first coin and succeeding coins including the next-to-last coin entering the accumulation area in an edgewise ascending order.

3. The mechanism of claim 2 wherein said second part and coin abutment means cooperate to dispose the top edge of the next-to-last coin vertically higher than the first partition part.

4. The mechanism of claim 1 wherein the first coin and last coin to enter the coin accumulation area contact said abutment means.

5. The mechanism of claim 4 wherein location of the lower portion of said abutment means is proximate the lower portion of said push means path whereby the first coin and last coin will lose contact therewith the coin member is in its second position.

6. The mechanism of claim 1 including vending actuation means connecting said coin member to a vending assembly, said means being operated when the coin member moves from the first to the second position.

7. The mechanism of claim 2 wherein said second part includes an inner edge aligned on said coin member at an acute angle with respect to a vertical line drawn normal to the common pivot axis when the coin member is in its first position.

8. The mechanism of claim 1 including lever constraint means comprising a rotation stop member attached to a housing wall at a location to prevent contact of said push means with the first coin in said coin accumulation area.

9. The mechanism of claim 1 wherein said coin member is a disc shaped as the segment of a circle and said first partition part ledge extends at an incline downwardly toward said free edge.

10. The mechanism of claim 5 wherein said abutment means includes upper and lower face portions with the lower portion being closer to said free edge than the upper portion.

* * * * *